US009589781B2

(12) United States Patent
Okumura

(10) Patent No.: US 9,589,781 B2
(45) Date of Patent: Mar. 7, 2017

(54) ION GUIDE AND MASS SPECTROMETER

(75) Inventor: Daisuke Okumura, Osaka (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/995,042

(22) PCT Filed: Dec. 17, 2010

(86) PCT No.: PCT/JP2010/072778
§ 371 (c)(1),
(2), (4) Date: Jul. 2, 2013

(87) PCT Pub. No.: WO2012/081122
PCT Pub. Date: Jun. 21, 2012

(65) Prior Publication Data

US 2013/0284918 A1 Oct. 31, 2013

(51) Int. Cl.
*H01J 49/06* (2006.01)

(52) U.S. Cl.
CPC ..... *H01J 49/062* (2013.01); *H01J 49/063* (2013.01)

(58) Field of Classification Search
CPC ..... H01J 49/062; H01J 49/063
USPC ..... 250/382
See application file for complete search history.

(56) References Cited

U.S. PATENT DOCUMENTS 4,755,670 A * 7/1988 Syka et al. ..... 250/292
5,847,386 A * 12/1998 Thomson et al. ..... 250/288
6,075,244 A * 6/2000 Baba et al. ..... 250/292
6,111,250 A * 8/2000 Thomson et al. ..... 250/282
6,163,032 A * 12/2000 Rockwood ..... 250/396 R
(Continued)

FOREIGN PATENT DOCUMENTS

CA 2498842 A1 4/2004
CN 1685467 A 10/2005
(Continued)

OTHER PUBLICATIONS

International Search Report and Written Opinion mailed Jan. 18, 2011 for International Application No. PCT/JP2010/072778 (13 pages).
(Continued)

*Primary Examiner* — Nicole Ippolito
*Assistant Examiner* — Sean Luck
(74) *Attorney, Agent, or Firm* — Morgan, Lewis & Bockius LLP

(57) ABSTRACT

A curved ion guide includes four curved rod electrodes arranged around a curved central axis, two deflecting auxiliary electrodes which face each other across the axis, and two focusing auxiliary electrodes which are located on a curved surface orthogonal to the plane P and including the axis and which face each other across the axis. Ions are focused by the effect of an electric field created by radio-frequency voltages applied to the curved rod electrodes, and a deflecting electric field having the effect of curving ions along the axis is created by direct-current voltages applied to the deflecting auxiliary electrodes. Furthermore, a focusing direct-current electric field having the effect of pushing ions from the vicinity of the focusing auxiliary electrodes toward the axis is created by a direct-current voltage having the same polarity as that of the ions and applied to the focusing auxiliary electrodes.

10 Claims, 5 Drawing Sheets

(56) References Cited

U.S. PATENT DOCUMENTS

| | | | | |
|---|---|---|---|---|
| 6,417,511 | B1 * | 7/2002 | Russ et al. | 250/292 |
| 7,498,571 | B2 * | 3/2009 | Makarov et al. | 250/292 |
| 2004/0056190 | A1 | 3/2004 | Buttrill | |
| 2007/0018094 | A1 * | 1/2007 | Hager et al. | 250/292 |
| 2008/0048112 | A1 * | 2/2008 | Makarov et al. | 250/290 |
| 2008/0087809 | A1 * | 4/2008 | Russ et al. | 250/281 |
| 2008/0116372 | A1 * | 5/2008 | Hashimoto et al. | 250/292 |
| 2009/0159796 | A1 * | 6/2009 | Belford et al. | 250/294 |
| 2009/0294663 | A1 | 12/2009 | Muntean et al. | |
| 2009/0321655 | A1 * | 12/2009 | Makarov | H01J 49/065 250/396 R |
| 2010/0096541 | A1 * | 4/2010 | Okumura et al. | 250/281 |
| 2010/0116979 | A1 * | 5/2010 | Nishiguchi et al. | 250/281 |

FOREIGN PATENT DOCUMENTS

| | | | |
|---|---|---|---|
| EP | 1543538 | A2 | 6/2005 |
| EP | 2204840 | A2 | 7/2010 |
| JP | 2000-149865 | A | 5/2000 |
| JP | 2000268770 | A | 9/2000 |
| JP | 3542918 | B2 | 7/2004 |
| JP | 2006500751 | A | 1/2006 |
| JP | 2009-187771 | A | 8/2009 |
| JP | 2010123561 | A | 6/2010 |
| KR | 20050071502 | A | 7/2005 |
| WO | WO-2004030008 | A2 | 4/2004 |

OTHER PUBLICATIONS

Examination Report received for Japanese Patent Application No. 2012-548599 mailed on Apr. 22, 2014, 5 pages (2 pages of English Translation and 3 pages of Office Action).

* cited by examiner

ION GUIDE AND MASS SPECTROMETER

TECHNICAL FIELD

The present invention relates to an ion guide for transporting ions while focusing them, as well as a mass spectrometer using the ion guide.

BACKGROUND ART

In a mass spectrometer, an ion optical element called the "ion guide" is used for focusing ions coming from the previous stage, accelerating them in some cases, and sending them into a mass analyzer, such as a quadrupole mass filter. An ion guide generally has a multi-pole structure with four or eight cylindrical (or tubular) rod electrodes arranged parallel to each other around an ion beam axis. Normally, in the quadrupole or octapole ion guide, the same radio-frequency (RF) voltage is applied to one pair of rod electrodes facing each other across the ion beam axis, while another RF voltage, which is identical in amplitude and opposite in phase to the aforementioned RF voltage, is applied to another pair of rod electrodes neighboring the aforementioned pair in the circumferential direction. The thus applied RF voltages create an RF electric field in the space surrounded by the rod electrodes, and the ions are transported to the subsequent stage while being oscillated in this RF electric field.

In an ion guide disclosed in Patent Document 1, virtual rod electrodes, each of which consists of a plurality of plate electrodes arrayed along the ion beam axis, are used in place of the rod electrodes. In the virtual-rod configuration, a direct-current (DC) electric field having a potential gradient along the ion beam axis can be created so as to accelerate, or conversely, decelerate ions while exploiting the advantage of high ion-focusing performance of the multipole ion guide.

As already explained, ion guides are primarily used to transport various ions produced by an ion source to a mass analyzer. However, the particles introduced into the ion guide normally contain not only ions originating from a sample, but also neutral particles, such as the sample molecules which have not been ionized in the ion source. Such neutral particles, if allowed to reach the mass analyzer, will cause a measurement noise. Furthermore, they will also contaminate the mass analyzer. Given these problems, a curved ion guide using curved rod electrodes has been conventionally used to remove neutral particles in the course of their travel through the ion guide (for example, refer to Patent Document 2 or 3).

FIG. 8 is a schematic perspective view of one example of the curved ion guide. As shown, this ion guide 2 has four curved rod electrodes 201, 202, 203 and 204. Due to the effect of the RF electric field, ions which have originated from a sample follow a curved path along the shape of the ion guide, whereas neutral particles, which have no electric charges and will not be affected by the RF electric field, travel straightly through the ion guide 2, to be eventually eliminated by being discharged from the ion guide 2 or coming in contact with the curved rod electrodes 201-204.

Since the ions introduced into the ion guide 2 have certain amounts of energy, it is actually difficult to achieve both the focusing and curving of the ions along the curved path by using only the RF electric field. To address this problem, a curved ion guide disclosed in Patent Document 3 not only employs the curved shape of the rod electrodes but also applies a deflecting DC voltage to the curved rod electrodes or auxiliary electrodes provided independently of the curved rod electrodes, so as to create, in the space surrounded by the curved rod electrodes, a DC electric field which acts on the ions and curves them toward the inside of the curved path (as indicated by the arrow R in FIG. 8).

FIGS. 9 and 10 are configuration diagrams of the curved rod electrodes and the auxiliary electrodes described in Patent Document 3 as well as the circuit blocks for applying voltages to those electrodes. The system shown in FIG. 9 has no auxiliary electrodes. The thick white arrow in this figure points toward the inside of the curved path in the curved ion guide 2 (i.e. inward along the radial direction of the curved central axis, which is a segment of an arc). The voltage sources 501-504 apply an RF voltage $V_{RF}$ to the two curved rod electrodes 202 and 204 facing each other among the four curved rod electrodes 201-204, as well as an RF voltage $-V_{RF}$ with the same amplitude and opposite polarity to the other two curved rod electrodes 201 and 203. As a result, an RF electric field for focusing ions while oscillating them in the previously described manner is created in the space surrounded by the curved rod electrodes 201-204. The voltage sources 501-504 also apply a DC voltage $-V_{DEF}$ whose polarity is opposite to that of an ion to be analyzed (which is a positive ion in the present example) to the two curved rod electrodes 201 and 202 located on the inside of the curved path, as well as a DC voltage $V_{DEF}$ having the same polarity as that of the ion to be analyzed to the two curved rod electrodes 203 and 204 located on the outside of the curved path. As a result, a DC electric field for attracting ions toward the inside of the curved path, i.e. in the direction indicated by the thick white arrow in the figure, is created in the space surrounded by the curved rod electrodes 201-204.

The system shown in FIG. 10 has auxiliary electrodes 205 and 206. The voltage source 511 and 512 apply an RF voltage $V_{RF}$ to the two curved rod electrodes 202 and 204 facing each other among the four curved rod electrodes 201-204, as well as an RF voltage $-V_{RF}$ with the same amplitude and opposite polarity to the other two curved rod electrodes 201 and 203. The voltage source 514 applies a DC voltage $-V_{DEF}$ whose polarity is opposite to that of an ion to be analyzed to the auxiliary electrode 205 located on the inside of the curved path. The voltage source 513 applies a DC voltage $V_{DEF}$ having the same polarity as that of the ion to be analyzed to the auxiliary electrode 206 located on the outside of the curved path. As a result, similar to the system of FIG. 9, a DC electric field for attracting ions toward the inside of the curved path is created, in the form of being superposed on the ion-focusing RF electric field, in the space surrounded by the curved rod electrodes 201-204.

By applying appropriate deflecting DC voltages to either the curved rod electrodes or the auxiliary electrodes in the previously described manner, it is possible to curve ions along the curved path of the ion guide 2 and guide them to the exit end so as to improve the ion transmission efficiency. However, such conventional systems have the following problem.

That is to say, the DC electric field which acts on the ions in the radial direction within the inner space of the ion guide 2 in the previously described manner functions as an energy filter which allows the passage of ions only within a specific range of kinetic energy. Accordingly, the transmission efficiency of the ions deteriorates if the variation in the kinetic energy the ions introduced into the ion guide 2 is relatively large. To avoid this situation, it is necessary to reduce the relative variation of energy by comparatively increasing the kinetic energy of the ions introduced into the ion guide 2. For the ion guide disclosed in Patent Document 3, a difference in the ion transmission efficiency depending on the presence or absence of the deflecting DC electric field has been investigated for an ion having a considerably high kinetic energy of 100 eV. However, a study by the present inventor has revealed that, when ions with such a high kinetic energy are introduced into a curved ion guide, it is difficult to adequately focus the ions by using only the RF electric field. This constitutes a cause of deterioration in the ion transmission efficiency.

BACKGROUND ART DOCUMENT

Patent Document

Patent Document 1: JP-A 2000-149865
Patent Document 2: JP-B 3542918
Patent Document 3: US-A1 2009/0294663

SUMMARY OF THE INVENTION

Problem to be Solved by the Invention

The present invention has been developed to solve the previously described problem, and its objective is to provide a curved ion guide which exhibits a high ion-focusing performance and thereby achieves a high level of ion transmission efficiency even if the amount of kinetic energy of the introduced ions is large. An objective of the mass spectrometer according to the present invention is to enhance the detection sensitivity by using a curved ion guide with improved ion transmission efficiency.

Means for Solving the Problems

The first aspect of the present invention aimed at solving the aforementioned problem is an ion guide for transporting ions along a curved path while focusing the ions, including:

a) 2n pieces of curved rod electrodes (n is an integer equal to or greater than two) arranged around a curved central axis; and b) a voltage generator for applying voltages to the 2n pieces of curved rod electrodes as follows: radio-frequency voltages with opposite polarities are applied to any two curved rod electrodes neighboring each other in the circumferential direction among the 2n pieces of curved rod electrodes; a deflecting direct-current voltage is applied to at least one of the curved rod electrodes in addition to the radio-frequency voltages, so as to attract ions in the space surrounded by the 2n pieces of curved rod electrodes toward the inside of the curvature of the curved central axis in a plane orthogonal to the curved central axis; and a focusing direct-current voltage is applied to at least two curved rod electrodes facing each other across the curved central axis, exclusive of the curved rod electrodes to which the deflecting direct-current voltage is applied, in addition to the radio-frequency voltages, so as to push the ions in the space surrounded by the 2n pieces of curved rod electrodes toward the curved central axis from outside, in the plane orthogonal to the curved central axis and along a line orthogonal or oblique to the direction in which the ions are attracted due to the deflecting direct-current voltage.

In the first aspect of the present invention, n is an integer equal to or greater than two, and in principle, it has no upper limit. However, in practice, n should preferably be within a range from two to four; i.e. the curved rod electrodes should preferably be constructed as a quadrupole, hexapole or octapole structure.

In one mode of the ion guide according to the first aspect of the present invention, the ion guide has a quadrupole structure of n=2 with four curved rod electrodes arranged in such a manner that one pair of the curved rod electrodes facing each other across the curved central axis have the centers thereof located on a flat plane on which the curved central axis lies while the other pair of the curved rod electrodes have the centers thereof located on a curved surface orthogonal to the flat plane and including the curved central axis, and the voltage generator applies the deflecting direct-current voltage to one or both of the pair of the curved rod electrodes having the center thereof located on the flat plane and the focusing direct-current voltage having the same polarity as that of an ion to be analyzed to the other pair of the curved rod electrodes.

In the ion guide according to the first aspect of the present invention, ions introduced into the space surrounded by the 2n pieces of curved rod electrodes experience not only the focusing effect due to the radio-frequency electric field, but also a force due to the direct-current electric field created by the curved rod electrode to which the focusing direct-current voltage is applied, and this force compresses the ions into a region near the curved central axis in a direction orthogonal or oblique to the radial direction in which the ions are gradually curved. Therefore, even in the case where ions which have been introduced with considerably large amounts of kinetic energy travel along a curved path under the effect of the deflecting direct-current electric field, the ions are prevented from spreading, so that they can reach the exit end of the ion guide with high efficiency. Thus, a high level of ion transmission efficiency can be achieved.

In another mode of the ion guide according to the first aspect of the present invention, each of the curved rod electrodes is a curved virtual rod electrode composed of an array of plate electrodes arranged along the curved central axis, and the voltage generator applies, as the focusing direct-current voltage, a voltage having the same polarity as that of an ion to be analyzed and a voltage having an opposite polarity, to the array of the plate electrodes constituting one curved virtual rod electrode so that these two voltages alternate in the array.

In this configuration, the direct-current electric field created by the focusing direct-current voltage has the effect of focusing the ions at every other plate electrode of the curved virtual rod electrode when ions are travelling along the curved path. This system functions as a plurality of serially arranged ion lenses, whereby the ions can be efficiently transported.

The second aspect of the present invention aimed at solving the aforementioned problem is an ion guide for transporting ions along a curved path while focusing the ions, including:

a) 2n pieces of curved rod electrodes (n is an integer equal to or greater than two) arranged around a curved central axis, with none of the curved rod electrodes being located on a flat plane on which the curved central axis lies;

b) a deflecting auxiliary electrode having a curved shape, located on the flat plane on which the curved central axis lies and between the curved rod electrodes neighboring each other in the circumferential direction;

c) a focusing auxiliary electrode having a curved shape, located on a curved surface which is orthogonal or oblique to the flat plane and which includes the curved central axis and between the curved rod electrodes neighboring each other in the circumferential direction;

d) a main voltage generator for applying radio-frequency voltages with opposite polarities to any two curved rod electrodes neighboring each other in the circumferential direction among the 2n pieces of curved rod electrodes; and e) an auxiliary voltage generator for applying a deflecting direct-current voltage to the deflecting auxiliary electrode so as to attract ions in the space surrounded by the 2n pieces of curved rod electrodes toward the inside of the curvature of the curved central axis in a plane orthogonal to the curved central axis, and for applying a focusing direct-current voltage to the focusing auxiliary electrode so as to push the ions in the space surrounded by the 2n pieces of curved rod electrodes toward the curved central axis from outside, in the plane orthogonal to the curved central axis and along a line orthogonal or oblique to the direction in which the ions are attracted due to the deflecting direct-current voltage.

Similar to the first aspect of the present invention, in the second aspect of the present invention, n is an integer equal to or greater than two, and in principle, it has no upper limit. However, in practice, n should preferably be within a range from two to four; i.e. the curved rod electrodes should preferably be constructed as a quadrupole, hexapole or octapole structure.

In one mode of the ion guide according to the second aspect of the present invention, the ion guide has a quadrupole structure of n=2 with one pair of the deflecting auxiliary electrodes facing each other across the curved central axis and one pair of the focusing auxiliary electrodes facing each other across the curved central axis on a curved surface orthogonal to the flat surface, and the auxiliary voltage generator applies a deflecting direct-current voltage whose polarity is opposite to that of an ion to be analyzed to one of the deflecting auxiliary electrodes located on the inside of the curvature, a deflecting direct-current voltage having the same polarity as that of the ion to be analyzed to the other one of the deflecting auxiliary electrodes located on the outside of the curvature, and a focusing direct-current voltage having the same polarity as that of the ion to be analyzed to both of the focusing auxiliary electrodes.

In the ion guide according to the second aspect of the present invention, ions introduced into the space surrounded by the 2n pieces of curved rod electrodes experience not only the focusing effect due to the radio-frequency electric field, but also a force due to the direct-current electric field created by the focusing auxiliary electrodes to which the focusing direct-current voltage is applied, and this force compresses the ions into a region near the curved central axis in a direction orthogonal or oblique to the radial direction in which the ions are gradually curved. Therefore, even in the case where ions which have been introduced with considerably large amounts of kinetic energy travel along the curved path under the effect of the deflecting direct-current electric field, the ions are prevented from spreading, so that they can reach the exit end of the ion guide with high efficiency. Thus, a high level of ion transmission efficiency can be achieved.

In addition to the focusing direct-current voltage, a radio-frequency voltage for strengthening the effect of the radio-frequency electric field may also be applied to the focusing auxiliary electrode.

A mass spectrometer according to the third aspect of the present invention aimed at solving the aforementioned problem is characterized in that an ion guide according to the first or second aspect of the present invention is provided between an ion source and a mass analyzer.

By this system, ions produced by the ion source can be efficiently transported to the mass analyzer, while neutral particles, which are unnecessary for the analysis and which may possibly contaminate the system and cause measurement noises, are removed before arriving at the mass analyzer.

Effect of the Invention

In the ion guide according to the first or second aspect of the present invention, ions can be transported along a curved path in a more focused form than in the conventional curved ion guides, so that a higher level of ion transmission efficiency can be achieved. In the mass spectrometer according to the third aspect of the present invention which uses the ion guide according to the first or second aspect of the present invention, the amount of ions to be subjected to the mass spectrometry will be larger than in the case of using the conventional curved ion guide, so that the sensitivity and accuracy of the analysis will improve.

BEST MODE FOR CARRYING OUT THE INVENTION

The ion guide according to the present invention and the mass spectrometer using the ion guide are hereinafter described by means of embodiments.

[First Embodiment]

Figure 1:
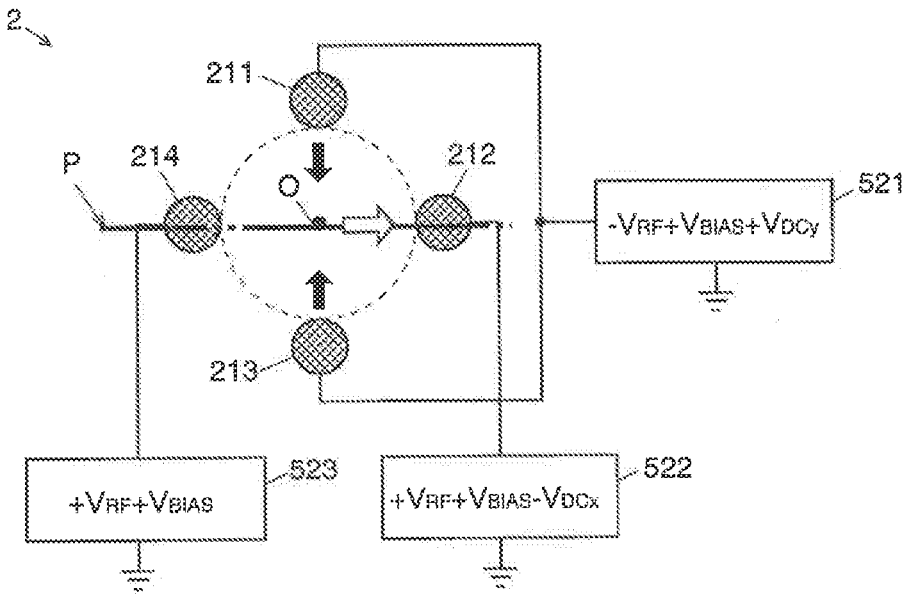
FIG. 1 is a schematic configuration diagram of an ion guide according to one embodiment (first embodiment) of the present invention.
Figure 2:
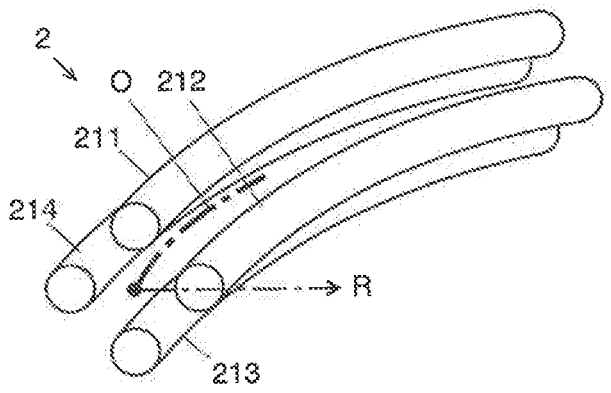
FIG. 2 is a perspective view of the curved rod electrodes of the ion guide according to the first embodiment.
Figure 3:
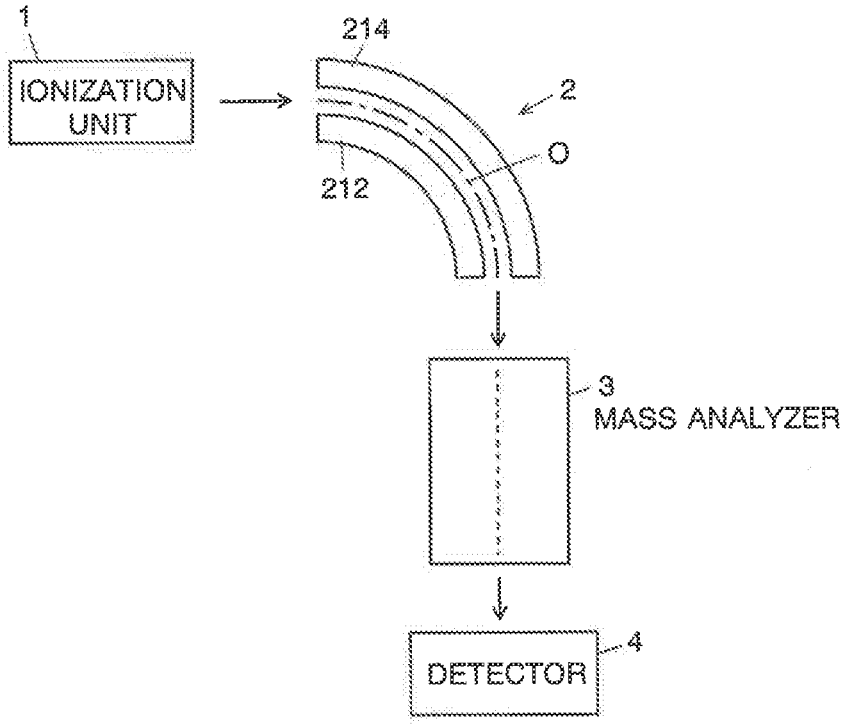
FIG. 3 is a schematic configuration diagram of a mass spectrometer using the ion guide according to the first embodiment.

FIG. 1 is a schematic configuration diagram of an ion guide according to the first embodiment, FIG. 2 is a perspective view of the curved rod electrodes of the curved ion guide according to the first embodiment, and FIG. 3 is a schematic configuration diagram of a mass spectrometer having this curved ion guide.

As shown in FIG. 3, in the present mass spectrometer, ions generated from a sample and ejected from an ionization unit (ion source) 1 are introduced into a curved ion guide 2 for bending their path by approximately 90°, in which the ions follow the curved central axis O of the ion guide 2, gradually bending their traveling direction, to be ejected from the exit end of the ion guide 2. Neutral particles, such as the sample molecules introduced from the ionization unit 1 into the ion guide 2 together with the ions, travel straightly, without being affected by the electric field within the ion guide 2, to be separated from the ions and removed. The ions ejected from the exit end of the ion guide 2 are introduced into a mass analyzer 3, such as a quadrupole mass filter, in which the ions are separated according to their mass-to-charge ratios and arrive at a detector 4.

As shown in FIG. 2, the ion guide 2 has four curved rod electrodes 211-214 arranged around the curved central axis O. Among them, two curved rod electrodes 212 and 214 have their centers located on a flat plane P (which corresponds to the plane of paper in FIG. 3) on which the curved central axis O, which is a segment of an arc, lies. The other two curved rod electrodes 211 and 213 have their centers located on a curved surface orthogonal to the flat plane P and including the curved central axis O. The curved rod electrodes 211-214 shown in FIG. 1 are their end faces created by cutting the curved rod electrodes 211-214 at a plane orthogonal to the curved central axis O in FIG. 2.

Figure 9:
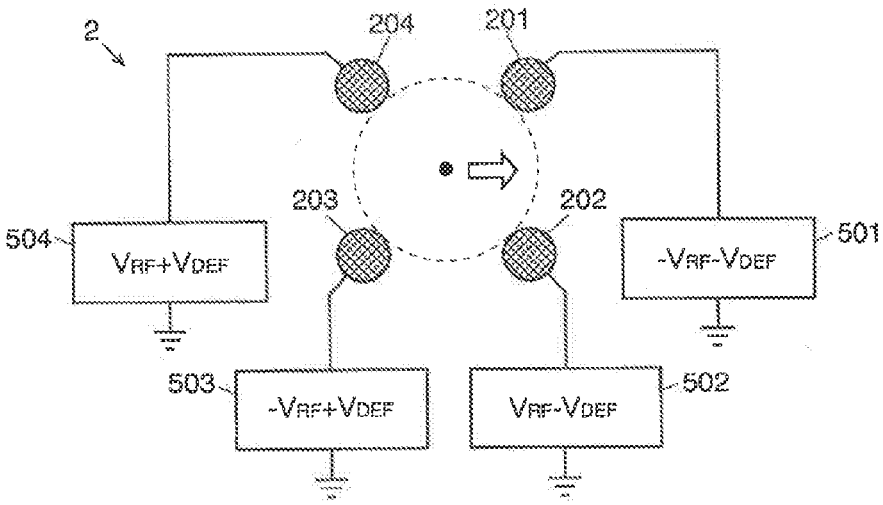
FIG. 9 is a diagram showing an electrode configuration and a circuit configuration of voltage sources in a conventional curved ion guide.
Figure 10:
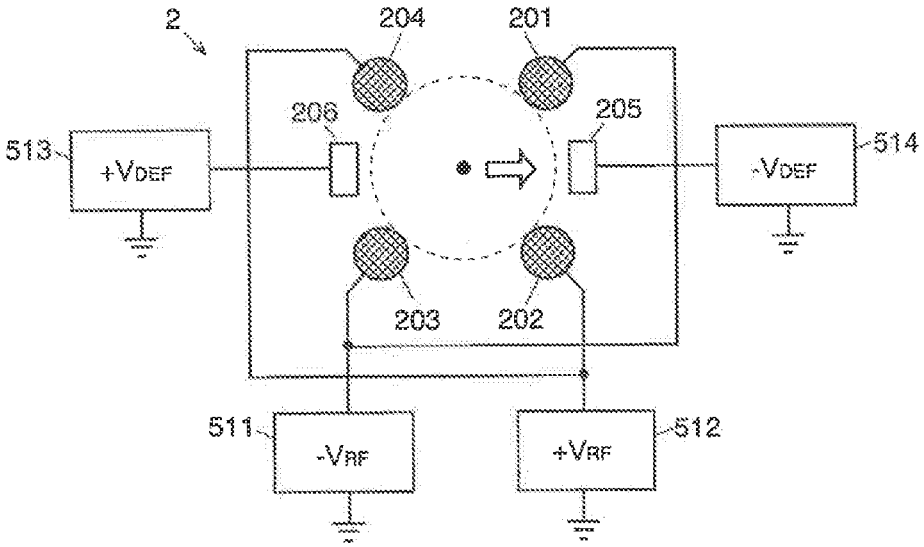
FIG. 10 is a diagram showing an electrode configuration and a circuit configuration of voltage sources in a conventional curved ion guide.

As shown in FIG. 1, the voltage sources 522 and 523 apply a radio-frequency (RF) voltage $V_{RF}$, with a predetermined direct-current (DC) bias voltage $V_{BIAS}$ superposed thereon, to the two curved rod electrodes 212 and 214 facing each other among the four curved rod electrodes 211-214, as well as an RF voltage $-V_{RF}$ which is identical in amplitude and opposite in polarity to the RF voltage $V_{RF}$, with the predetermined DC bias voltage $V_{BIAS}$ superposed thereon, to the other two curved rod electrodes 211 and 213. The DC bias voltage $V_{BIAS}$ is a voltage applied to all the curved rod electrodes 211-214. This DC bias voltage $V_{BIAS}$ itself does not create any DC electric field within the ion guide 2. It should be noted that FIGS. 9 and 10 are the examples of DC bias voltage $V_{BIAS}=0$. As explained earlier, an RF electric field for focusing ions while oscillating them is created within the ion guide 2 by the RF voltages $V_{RF}$ and $-V_{RF}$ applied to the curved rod electrodes 211-214. This is the same as in the conventional case.

The voltage source 522 applies, as the deflecting DC voltage, a DC voltage $-V_{DCx}$ whose polarity is opposite to that of an ion to be analyzed (which is a positive ion in the present example), to the curved rod electrode 212 located on the inside of the curved path. The fact that no deflecting DC voltage is applied to the curved rod electrode 214 facing across the curved central axis O can be regarded as the application of a deflecting DC voltage of 0 V. By these voltages, a DC electric field for attracting ions toward the inside of the curved path, i.e. in the direction indicated by the thick white arrow in FIG. 1, is created within the ion guide 2. The effect of this DC electric field is also the same as in the conventional case.

Furthermore, in this ion guide 2, the voltage source 521 applies, as the focusing DC voltage, a DC voltage $V_{DCy}$ having the same polarity as that of the ion to be analyzed, to the two curved rod electrodes 211 and 213 facing each other across the curved central axis O. The DC electric field created in the vicinity of the curved rod electrodes 211 and 213 by the application of this focusing DC voltage (the focusing DC electric field) acts on the ions within the ion guide 2 so as to repel them from the curved rod electrodes 211 and 213. That is to say, as indicated by the thick arrows in FIG. 1, the ions experience forces directed from the regions near the two curved rod electrodes 211 and 213 toward the curved central axis O, so that they will not be easily spread outward, but will be focused into the region near the curved central axis O, changing their traveling direction due to the effect of the deflecting DC electric field. In the ion guide 2 of the present embodiment, the spread of the ions is prevented by the combined effect of the focusing DC electric field and the RF electric field, so that the ions can be efficiently transported along the curved central axis O to the exit end.

[Second Embodiment]

Figure 4:
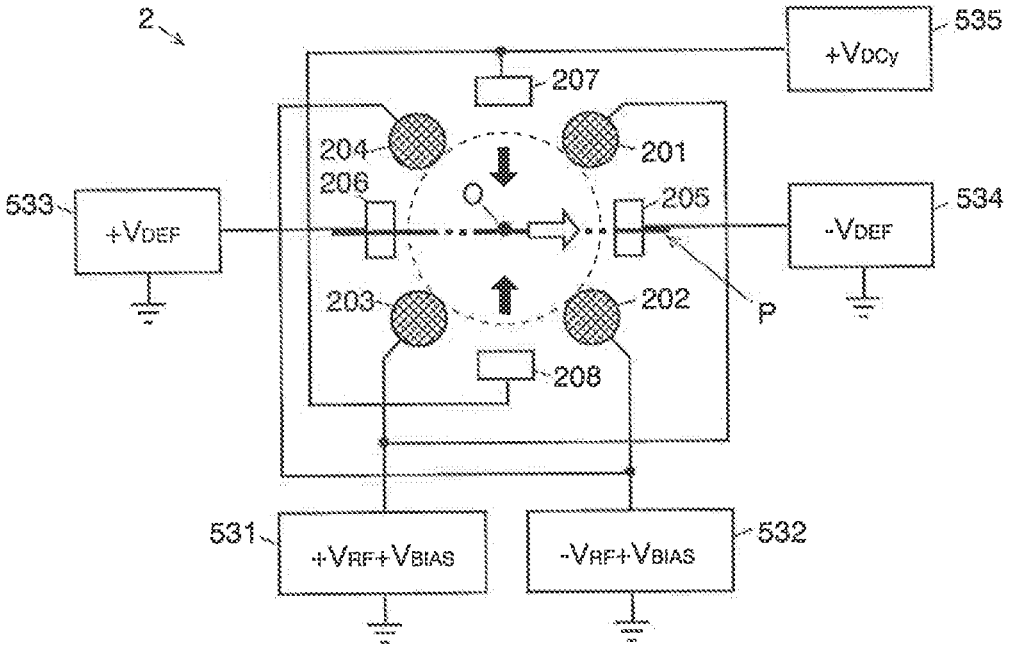
FIG. 4 is a schematic configuration diagram of an ion guide according to another embodiment (second embodiment) of the present invention.
Figure 8:
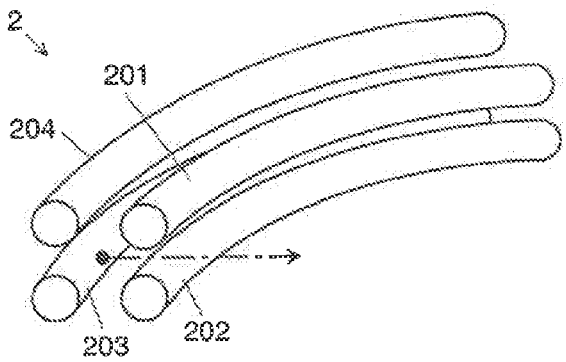
FIG. 8 is a perspective view of the curved rod electrodes of a curved ion guide.

FIG. 4 is a schematic configuration diagram of a curved ion guide according to the second embodiment. In the second embodiment, the structure and arrangement of the four rod electrodes 201-204 are not the same as those of the first embodiment, but the same as those of the conventional examples shown in FIGS. 8-10. That is to say, none of the four curved rod electrodes 201-204 are located on the flat plane P on which the curved central axis O lies or the curved surface orthogonal to the flat plane P and including the curved central axis O. Similar to the conventional example shown in FIG. 10, a pair of deflecting auxiliary electrodes 205 and 206 facing each other across the curved central axis O is provided on the flat plane P on which the curved central axis O lies. Furthermore, a pair of focusing auxiliary electrodes 207 and 208 facing each other across the curved central axis O is provided on the curved surface orthogonal to the flat plane P and including the curved central axis O. Each of the focusing auxiliary electrodes 207 and 208 has a rectangular cross section and extends in a curved shape parallel to the curved central axis O.

As shown in FIG. 4, the voltage source 531 applies an RF voltage $V_{RF}$, with a predetermined DC bias voltage $V_{BIAS}$ superposed thereon, to the two curved rod electrodes 201 and 203 facing each other among the four curved rod electrodes 201-204. The voltage source 532 applies an RF voltage $-V_{RF}$ which is identical in amplitude and opposite in polarity to the RF voltage $V_{RF}$, with the predetermined DC bias voltage $V_{BIAS}$ superposed thereon, to the other two curved rod electrodes 202 and 204. As a result, an RF electric field for focusing ions while oscillating them is created within the ion guide 2.

The voltage source 533 applies, as the deflecting DC voltage, a DC voltage $V_{DEF}$ having the same polarity as that of the ion to be analyzed, to the deflecting auxiliary electrode 206 located on the outside of the curved path. The voltage source 534 applies, as the deflecting DC voltage, a DC voltage $-V_{DEF}$ whose polarity is opposite to that of the ion to be analyzed, to the curved rod electrode 205 located on the inside of the curved path. By these voltages, a DC electric field for attracting ions toward the inside of the curved path, i.e. in the direction indicated by the thick white arrow in FIG. 4, is created within the ion guide 2.

Furthermore, in this ion guide 2, the voltage source 535 applies, as the focusing DC voltage, a DC voltage $V_{DCy}$ having the same polarity as that of the ion to be analyzed, to the focusing auxiliary electrodes 207 and 208 facing each other across the curved central axis O. The DC electric field created in the vicinity of the focusing auxiliary electrodes 207 and 208 by the application of this focusing DC voltage acts on the ions within the ion guide 2 so as to make them move away from the curved rod electrodes 201-204.

Figure 5A:
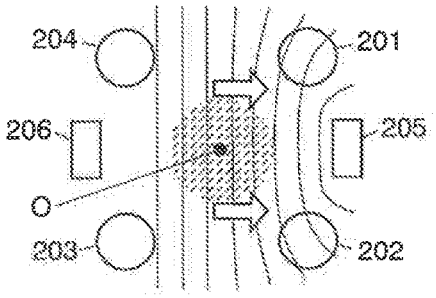
FIGS. 5A and 5B are model diagrams comparing a direct-current electric field in a conventional ion guide with a direct-current electric field in the ion guide according to the second embodiment.
Figure 5B:
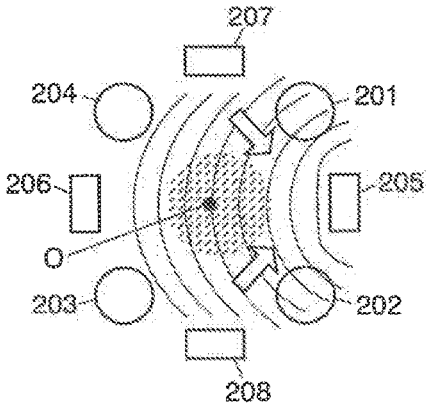

FIGS. 5A and 5B are diagrams schematically showing equipotential lines due to the DC electric field in a plane orthogonal to the curved central axis O, where FIG. 5A is a model diagram corresponding to a conventional example, and FIG. 5B is a model diagram corresponding to the second embodiment shown in FIG. 3. As shown in FIG. 5A, in the conventional system, the equipotential lines in the space surrounded by the curved rod electrodes 201-204 are almost straight, in which ions will merely experience a force directed toward the inside of the curved central axis O. By contrast, as shown in FIG. 5B, in the system of the second embodiment, the equipotential lines in the space surrounded by the curved rod electrodes 201-204 are curved, with their middle portions bulging leftward (or toward the outside of the curved central axis O). In this field, ions experience the resultant force of the force directed inward from the curved central axis O and the forces directed from the vicinity of the focusing auxiliary electrodes 207 and 208 toward the curved central axis O. Accordingly, the ions will not be easily spread outward, but will be focused into the region near the curved central axis O, changing their travelling direction along the curvature of the curved central axis O due to the effect of the deflecting DC electric field. As a result, the ions will reach the exit end with high efficiency.

An RF voltage may additionally be superposed on the focusing DC voltage and applied to the focusing auxiliary electrodes 207 and 208 so as to assist the creation of the RF electric field.

[Third Embodiment]

Figure 6:
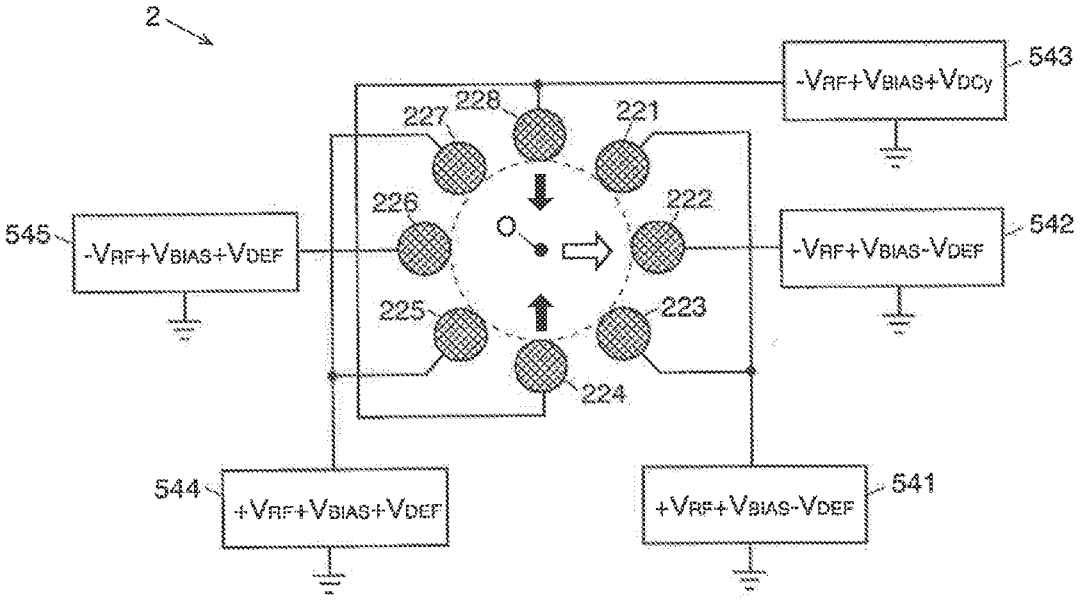
FIG. 6 is a schematic configuration diagram of an ion guide according to another embodiment (third embodiment) of the present invention.

FIG. 6 is a schematic configuration diagram of a curved ion guide according to the third embodiment. The ion guide according to the third embodiment has an octapole configuration with eight curved rod electrodes 221-228. This system can be created by adding one curved rod electrode between each and every pair of the curved rod electrodes neighboring each other in the circumferential direction in the quadrupole ion guide shown in the first embodiment. The voltage source 541 and 544 apply an RF voltage $V_{RF}$, with a predetermined DC bias voltage $V_{BIAS}$ superposed thereon, to the four curved rod electrodes 221, 223, 225 and 227 which do not neighbor each other in the circumferential direction (i.e. every other curved rod electrode). The voltage sources 542, 543 and 545 apply an RF voltage $-V_{RF}$ which is identical in amplitude and opposite in polarity to the RF voltage $V_{RF}$, with the predetermined DC bias voltage $V_{BIAS}$ superposed thereon, to the other four curved rod electrodes 222, 224, 226 and 228. An RF electric field for focusing ions while oscillating them is created within the ion guide 2.

The voltage sources 541 and 542 apply, as the deflecting DC voltage, a DC voltage $-V_{DEF}$ whose polarity is opposite to that of the ion to be analyzed, to the three curved rod electrodes 221, 222 and 223 located on the inside of the curved path. The voltage source 534 applies, as the deflecting DC voltage, a DC voltage $V_{DEF}$ having the same polarity as that of the ion to be analyzed, to the three curved rod electrodes 225, 226 and 227 located on the outside of the curved path. By these voltages, a DC electric field for attracting ions toward the inside of the curved path, i.e. in the direction indicated by the thick white arrow in FIG. 6, is created within the ion guide 2. It is also possible to apply the deflecting DC voltages to only the curved rod electrodes 222 and 226.

Furthermore, the voltage source 543 applies, as the focusing DC voltage, a DC voltage $V_{DCy}$ having the same polarity as that of the ion to be analyzed, to the two curved rod electrodes 224 and 228 facing each other across the curved central axis O. The DC electric field created in the vicinity of the curved rod electrodes 224 and 228 by the application of this focusing DC voltage acts on the ions within the ion guide 2 so as to push them from the curved rod electrodes 211 and 213 toward the curved central axis O. Thus, similar to the previously described embodiments, the ions will be curved along the curved central axis O while being prevented from spreading.

[Fourth Embodiment]

Figure 7A:
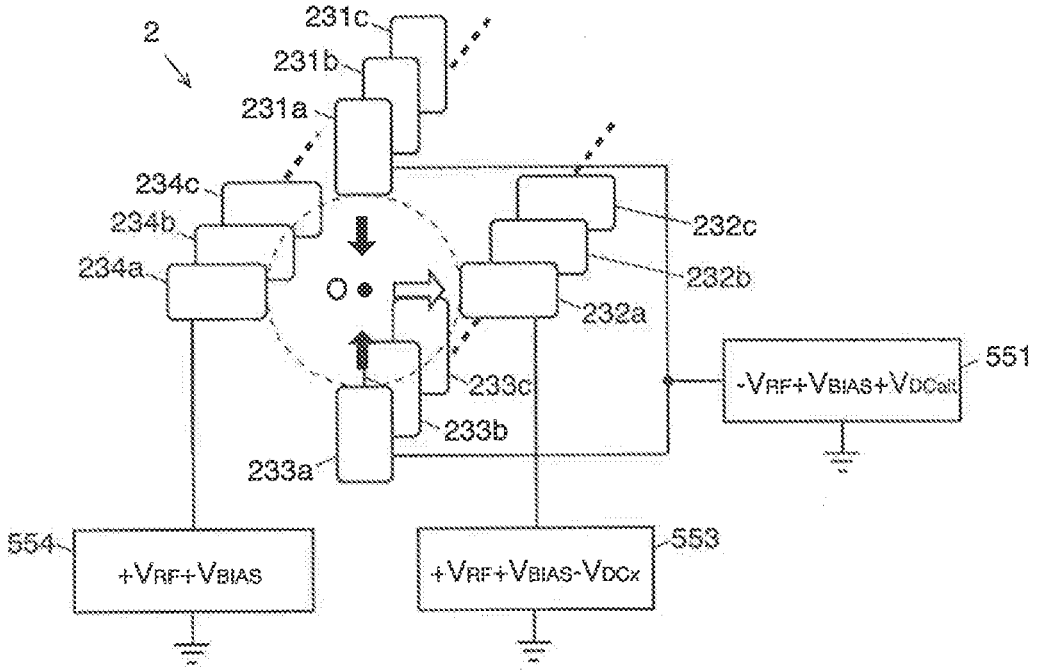
FIGS. 7A and 7B are schematic configuration diagrams of an ion guide according to another embodiment (fourth embodiment) of the present invention.
Figure 7B:
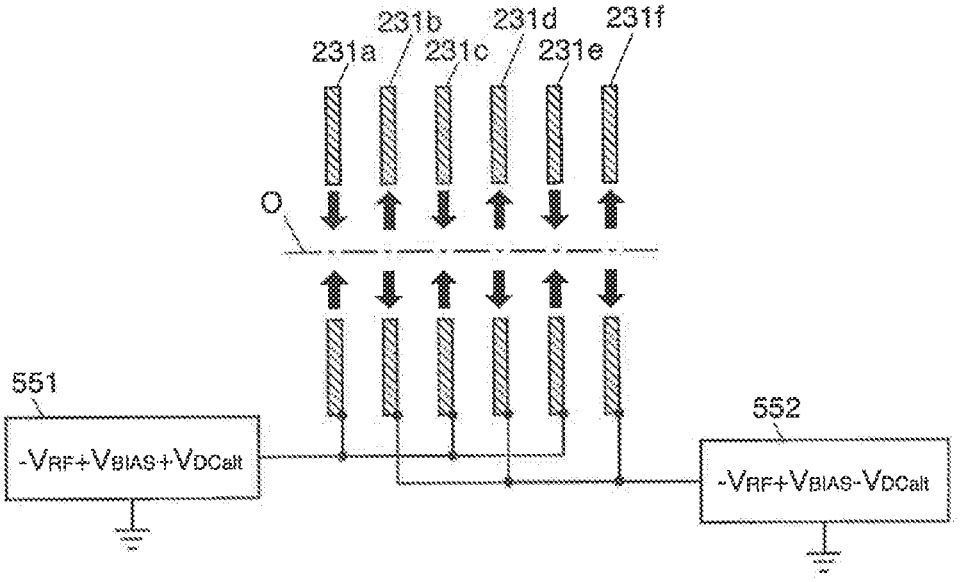

FIGS. 7A and 7B are schematic diagrams of a curved ion guide according to the fourth embodiment. Similar to the first embodiment, the ion guide according to the fourth embodiment has a quadrupole structure with no auxiliary electrodes. A difference exists in that curved virtual rod electrodes are used in place of the curved rod electrodes. That is to say, each curved virtual rod electrode is composed of a plurality of plate electrodes (e.g. 231*a*-231*f*) arrayed at intervals along the curved central axis O (the number of plate electrodes, which is six in the example of FIG. 7B, may be any number), and there are four such curved virtual rod electrodes arranged at angular intervals of 90° around the curved central axis O. Although the plurality of plate electrodes constituting one curved virtual rod electrode shown in FIG. 7A are linearly arrayed, their positions should actually be shifted so that they will be arrayed along the curvature of the curved central axis O. The reason for the straight appearance of the curved central axis O in FIG. 7B is because FIG. 7B is a diagram showing end faces created by cutting the curved virtual rod electrodes in FIG. 7A at a curved surface orthogonal to the flat plane on which the curved central axis O lies and including the curved central axis O.

The voltage sources 553 and 554 apply an RF voltage $V_{RF}$, with a predetermined DC bias voltage $V_{BIAS}$ superposed thereon, to the plate electrodes 232*a*, 232*b*, . . . , 234*a*, 234*b*, . . . included in the two curved virtual rod electrodes facing each other across the curved central axis O. The voltage source 551 applies an RF voltage $-V_{RF}$ which is identical in amplitude and opposite in polarity to the RF voltage $V_{RF}$, with the predetermined DC bias voltage $V_{BIAS}$ superposed thereon, to the plate electrodes 231*a*, 231*b*, . . . , 233*a*, 233*b*, . . . included in the other two curved virtual rod electrodes. As a result, an RF electric field for focusing ions while oscillating them is created within the ion guide 2.

The voltage source 553 applies, as the deflecting DC voltage, a DC voltage $-V_{DCx}$ whose polarity is opposite to that of the ion to be analyzed, to the plate electrodes 232*a*, 232*b*, . . . included in the curved virtual rod electrode located on the inside of the curved path. This is the same as the first embodiment, and by this voltage, a DC electric field for attracting ions toward the inside of the curved path, i.e. in the direction indicated by the thick white arrow in FIG. 7A, is created within the ion guide 2.

Furthermore, the voltage source 551 applies, as the focusing DC voltage, a DC voltage $V_{DCalt}$ having the same polarity as that of the ion to be analyzed, to the foremost plate electrodes 231*a* and 233*a* as well as every other subsequent plate electrode (231*c*, 233*c*, 231*e* and 233*e*) included in the two curved virtual rod electrodes facing each other across the curved central axis O. Similarly, the voltage source 552 applies, as the focusing DC voltage, a DC voltage $-V_{DCalt}$ whose polarity is opposite to that of the ion to be analyzed, to the second foremost plate electrodes 231*b* and 233*b* as well as every other subsequent plate electrode (231*d*, 233*d*, 231*f* and 233*f*) included in the two curved virtual rod electrodes facing each other across the curved central axis O. The plate electrodes 231*a*, 233*a*, 231*c*, 233*c*, 231*e* and 233*e* to which the DC voltage $V_{DCalt}$ is applied function as convex ion lenses for pushing ions toward the curved central axis O when the ions are passing through the spaces surrounded by these electrodes. On the other hand, the plate electrodes 231*b*, 233*b*, 231*d*, 233*d*, 231*f* and 233*f* to which the DC voltage $-V_{DCalt}$ is applied function as concave ion lenses for pushing ions away from the curved central axis O when the ions are passing through the spaces surrounded by these electrodes. Thus, the ions are repeatedly focused and defocused as they move forward, whereby the ions are efficiently transported to the exit end.

As described thus far, the ion guide according to any of the first through fourth embodiments of the present invention transports ions while curving them along the curved central axis O and preventing the spread of the ions by the effect of the focusing DC electric field. Accordingly, as compared to conventional curved ion guides, it can achieve a higher level of ion transmission efficiency.

The ion guide according to the present invention can be used not only in the section between the ionization unit and the mass analyzer, but also in various sections of the mass spectrometer in which it is necessary to transport ions to the subsequent stage while focusing them. For example, the previously described curved ion guide can be used as the ion guide contained in a collision cell of a triple quadrupole mass spectrometer. Furthermore, the ion guide according to the present invention can be used not only in mass spectrometers but also in various kinds of apparatuses or systems which require controlling the motion of ions.

It should be noted that any of the previously described embodiments is a mere example, and any change, modification or addition appropriately made within the spirit of the present invention will evidently fall within the scope of claims of the present patent application. For example, although the ion guides in the previous embodiments are either a quadrupole or octapole type, it is possible to adopt a hexapole structure or a multi-pole structure with ten or more poles.

EXPLANATION OF NUMERALS

1 . . . Ionization Unit
2 . . . Ion Guide
2 . . . Curved Ion Guide
201-204, 211-214, 221-228 . . . Curved Rod Electrode
205, 206 . . . Deflecting Auxiliary Electrode
207, 208 . . . Focusing Auxiliary Electrode
231*a*-231*f*, 232*a*-232*c*, 233*a*-233*f*, 234*a*-234*c* . . . Plate Electrode
3 . . . Mass Analyzer
4 . . . Detector
521-523, 531-535, 541-545, 551-554 . . . Voltage Source
O . . . Curved Central Axis

The invention claimed is:

1. An ion guide for transporting ions along a curved path while focusing the ions, comprising:

a) 2n pieces of curved rod electrodes where n is an integer equal to or greater than two, arranged around a curved central axis;

b) a voltage generator for applying voltages to the 2n pieces of curved rod electrodes having;

b1) a radio-frequency voltage generator for applying radio-frequency voltages with opposite polarities to any two curved rod electrodes neighboring each other in a circumferential direction among the 2n pieces of curved rod electrodes;

b2) a deflecting direct-current voltage generator for applying a deflecting direct-current voltage to at least one of the curved rod electrodes; and b3) a focusing direct-current voltage generator for applying a focusing direct-current voltage to at least two curved rod electrodes facing each other across the curved central axis, exclusive of the curved rod electrodes to which the deflecting direct-current voltage generator applies the deflecting direct-current voltage, the focusing direct-current voltage having a same polarity as that of the ions and being applied from both sides of the curved central axis in a direction which is perpendicular to a direction in which the ions are deflected by the deflecting direct-current voltage; and c) a voltage controller for controlling the radio-frequency voltage generator, the deflecting direct-current voltage generator, and the focusing direct-current voltage generator, and for forming a first electric potential which attracts ions in a space surrounded by the 2n pieces of curved rod electrodes toward an inside of a curvature of the curved central axis in a plane orthogonal to the curved central axis by the deflecting direct-current voltage, a second electric potential which pushes the ions in the space surrounded by the 2n pieces of curved rod electrodes toward the curved central axis from outside, in the plane orthogonal to the curved central axis and along a line orthogonal or oblique to a direction in which the ions are attracted due to the first potential by the focusing direct-current voltage.

2. The ion guide according to claim 1, wherein:

the ion guide has a quadrupole structure of n=2 with four curved rod electrodes arranged in such a manner that one pair of the curved rod electrodes facing each other across the curved central axis have centers thereof located on a flat plane on which the curved central axis lies while another pair of the curved rod electrodes have centers thereof located on a curved surface orthogonal to the flat plane and including the curved central axis; and the voltage generator applies the deflecting direct-current voltage to one or both of the pair of the curved rod electrodes having the center thereof located on the flat plane and the focusing direct-current voltage having a same polarity as that of an ion to be analyzed to the other pair of the curved rod electrodes.

3. The ion guide according to claim 1, wherein:

each of the curved rod electrodes is a curved virtual rod electrode composed of an array of plate electrodes arranged along the curved central axis; and the voltage generator applies, as the focusing direct-current voltage, a voltage having a same polarity as that of an ion to be analyzed and a voltage having an opposite polarity, to the array of the plate electrodes constituting one curved virtual rod electrode so that these two voltages alternate in the array.

4. An ion guide for transporting ions along a curved path while focusing the ions, comprising:

a) 2n pieces of curved rod electrodes where n is an integer equal to or greater than two, arranged around a curved central axis, with none of the curved rod electrodes being located on a flat plane on which the curved central axis lies;

b) a pair of deflecting auxiliary electrodes facing across the central axis, each having a curved shape, located on the flat plane on which the curved central axis lies and each deflecting auxiliary electrode located between the curved rod electrodes neighboring each other in a circumferential direction;

c) a pair of focusing auxiliary electrodes facing across the central axis, each having a curved shape, located on a curved surface which is orthogonal or oblique to the flat plane and which includes the curved central axis and each focusing auxiliary electrode located between the curved rod electrodes neighboring each other in the circumferential direction;

d) a main voltage generator for applying radio-frequency voltages with opposite polarities to any two curved rod electrodes neighboring each other in the circumferential direction among the 2n pieces of curved rod electrodes;

e) an auxiliary voltage generator having:

e1) a deflecting direct-current voltage generator for applying a deflecting direct-current voltage to the deflecting auxiliary electrodes; and e2) a focusing direct-current voltage generator for applying a focusing direct-current voltage to the focusing auxiliary electrodes, the focusing direct-current voltage having a same polarity as that of the ions and being applied from both sides of the curved central axis in a direction which is perpendicular to a direction in which the ions are deflected by the deflecting direct-current voltage; and f) a voltage controller for controlling the main voltage generator, the deflecting direct-current voltage generator, and the focusing direct-current voltage generator, and for forming a first electric potential which attract ions in a space surrounded by the 2n pieces of curved rod electrodes toward an inside of a curvature of the curved central axis in a plane orthogonal to the curved central axis by the deflecting direct-current voltage;

a second electric potential which pushes the ions in the space surrounded by the 2n pieces of curved rod electrodes from both sides toward the curved central axis, in the plane orthogonal to the curved central axis and along a line orthogonal or oblique to a direction in which the ions are attracted due to the first potential by the focusing direct-current potential.

5. The ion guide according to claim 4, wherein:

the ion guide has a quadrupole structure of n=2with one pair of the deflecting auxiliary electrodes facing each other across the curved central axis and one pair of the focusing auxiliary electrodes facing each other across the curved central axis on a curved surface orthogonal to the flat surface; and the auxiliary voltage generator applies a deflecting direct-current voltage whose polarity is opposite to that of an ion to be analyzed to one of the deflecting auxiliary electrodes located on the inside of the curvature, a deflecting direct-current voltage having a same polarity as that of the ion to be analyzed to another one of the deflecting auxiliary electrodes located on the outside of the curvature, and a focusing direct-current voltage having the same polarity as that of the ion to be analyzed to both of the focusing auxiliary electrodes.

6. A mass spectrometer having an ion guide provided between an ion source and a mass analyzer, the ion guide comprising:

a) 2n pieces of curved rod electrodes where n is an integer equal to or greater than two, arranged around a curved central axis; and b) a voltage generator for applying voltages to the 2n pieces of curved rod electrodes having:

b1) a radio-frequency voltage generator for applying radio-frequency voltages with opposite polarities to any two curved rod electrodes neighboring each other in a circumferential direction among the 2n pieces of curved rod electrodes;

b2) a deflecting direct-current voltage generator for applying a deflecting direct-current voltage to at least one of the curved rod electrodes; and b3) a focusing direct-current voltage generator for applying a focusing direct-current voltage to at least two curved rod electrodes facing each other across the curved central axis, exclusive of the curved rod electrodes to which the deflecting direct-current voltage is applied, the focusing direct-current voltage having a same polarity as that of the ions and being applied from both sides of the curved central axis in a direction which is perpendicular to a direction in which the ions are deflected by the deflecting direct-current voltage;

c) a voltage controller for controlling the radio-frequency voltage generator, the deflecting direct-current voltage generator, and the focusing direct-current voltage generator, and forming a first electric potential which attracts ions in a space surrounded by the 2n pieces of curved rod electrodes toward an inside of a curvature of the curved central axis in a plane orthogonal to the curved central axis, a second electric potential which pushes the ions in the space surrounded by the 2n pieces of curved rod electrodes from both sides toward the curved central axis, in the plane orthogonal to the curved central axis and along a line orthogonal or oblique to a direction in which the ions are attracted due to the first electric potential by the focusing direct-current voltage.

7. The mass spectrometer according to claim 6, wherein:

the ion guide has a quadrupole structure of n=2 with four curved rod electrodes arranged in such a manner that one pair of the curved rod electrodes facing each other across the curved central axis have centers thereof located on a flat plane on which the curved central axis lies while another pair of the curved rod electrodes have centers thereof located on a curved surface orthogonal to the flat plane and including the curved central axis; and the voltage generator applies the deflecting direct-current voltage to one or both of the pair of the curved rod electrodes having the center thereof located on the flat plane and the focusing direct-current voltage having a same polarity as that of an ion to be analyzed to the other pair of the curved rod electrodes.

8. The mass spectrometer according to claim 6, wherein:

each of the curved rod electrodes is a curved virtual rod electrode composed of an array of plate electrodes arranged along the curved central axis; and the voltage generator applies, as the focusing direct-current voltage, a voltage having a same polarity as that of an ion to be analyzed and a voltage having an opposite polarity, to the array of the plate electrodes constituting one curved virtual rod electrode so that these two voltages alternate in the array.

9. A mass spectrometer having an ion guide provided between an ion source and a mass analyzer, the ion guide comprising:

a) 2n pieces of curved rod electrodes where n is an integer equal to or greater than two, arranged around a curved central axis, with none of the curved rod electrodes being located on a flat plane on which the curved central axis lies;

b) a pair of deflecting auxiliary electrodes facing across the central axis, each having a curved shape, located on the flat plane on which the curved central axis lies and between the curved rod electrodes neighboring each other in a circumferential direction;

c) a pair of focusing auxiliary electrodes facing across the central axis, each having a curved shape, located on a curved surface which is orthogonal or oblique to the flat plane and which includes the curved central axis and between the curved rod electrodes neighboring each other in the circumferential direction;

d) a main voltage generator for applying radio-frequency voltages with opposite polarities to any two curved rod electrodes neighboring each other in the circumferential direction among the 2n pieces of curved rod electrodes; and e) an auxiliary voltage generator having:

e1) a deflecting direct-current voltage generator for applying a deflecting direct-current voltage to the deflecting auxiliary electrodes; and e2) a focusing direct-current voltage generator for applying a focusing direct-current voltage to the focusing auxiliary electrodes, the focusing direct-current voltage having a same polarity as that of the ions and being applied from both sides of the curved central axis in a direction which is perpendicular to a direction in which the ions are deflected by the deflecting direct-current voltage;

f) a voltage controller for controlling the main voltage generator, the deflecting direct-current voltage generator, and the focusing direct-current voltage generator, and for forming a first electric potential which attracts ions in a space surrounded by the 2n pieces of curved rod electrodes toward an inside of a curvature of the curved central axis in a plane orthogonal to the curved central axis, a second electric potential which pushes the ions in the space surrounded by the 2n pieces of curved rod electrodes from both sides toward the curved central axis, in the plane orthogonal to the curved central axis and along a line orthogonal or oblique to a direction in which the ions are attracted due to the first potential by the focusing direct-current potential.

10. The mass spectrometer according to claim 9, wherein:

the ion guide has a quadrupole structure of n=2 with one pair of the deflecting auxiliary electrodes facing each other across the curved central axis and one pair of the focusing auxiliary electrodes facing each other across the curved central axis on a curved surface orthogonal to the flat surface; and the auxiliary voltage generator applies a deflecting direct-current voltage whose polarity is opposite to that of an ion to be analyzed to one of the deflecting auxiliary electrodes located on the inside of the curvature, a deflecting direct-current voltage having a same polarity as that of the ion to be analyzed to another one of the deflecting auxiliary electrodes located on the outside of the curvature, and a focusing direct-current voltage having the same polarity as that of the ion to be analyzed to both of the focusing auxiliary electrodes.

* * * * *